United States Patent [19]

Hoshino

[11] Patent Number: 4,811,646

[45] Date of Patent: Mar. 14, 1989

[54] HOLDING STRUCTURE FOR THE TREMOLO OF A GUITAR

[75] Inventor: Yoshihiro Hoshino, Nagoya, Japan

[73] Assignee: Hoshino Gakki Co., Ltd., Japan

[21] Appl. No.: 110,333

[22] Filed: Oct. 20, 1987

[30] Foreign Application Priority Data

Jun. 25, 1987 [JP] Japan ..... 62-97889

[51] Int. Cl.[4] ..... G10D 3/12

[52] U.S. Cl. ..... 84/313

[58] Field of Search ..... 84/313

[56] References Cited

U.S. PATENT DOCUMENTS 4,656,916 4/1987 Gressett ..... 84/313

4,681,010 7/1987 Wilkinson ..... 84/298

4,724,737 2/1988 Fender ..... 84/313

*Primary Examiner*—Lawrence R. Franklin

*Attorney, Agent, or Firm*—Ostrolenk, Faber, Gerb & Soffen

[57] ABSTRACT

In a tremolo device for a guitar the bridge tail piece has a hanging part extending into an opening in the guitar body. A tension spring in the guitar body engages the bottom end of the hanging part. It is positively secured there by an attachment piece at the end of the spring. The attachment piece is held in a receiver like a hole in the bottom of the hanging part. The neck of the attachment piece, just behind the receiver, is secured to the end of the hanging part. The attachment piece may be a hook. A compression plate is screwed over the neck of the attachment piece hook. Alternately, the attachment piece is a ring shaped hook that has a screw passed through it into a threaded opening in the hanging part. A washer is pressed by that screw against the neck of the attachment piece. The invention obviates slippage which can create undesired noises, accidental disconnection of the spring, detuning of the instrument and permits the utilization of a tremolo arm with a full "arm-up" position.

2 Claims, 2 Drawing Sheets

FIG. 3
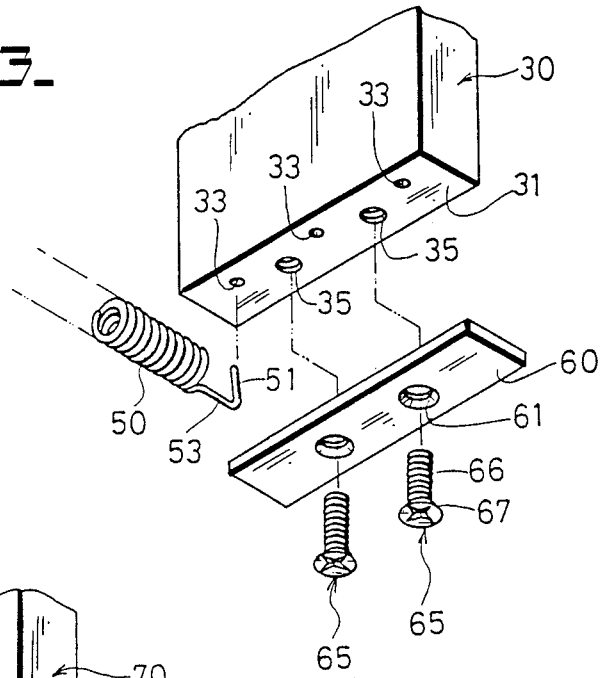
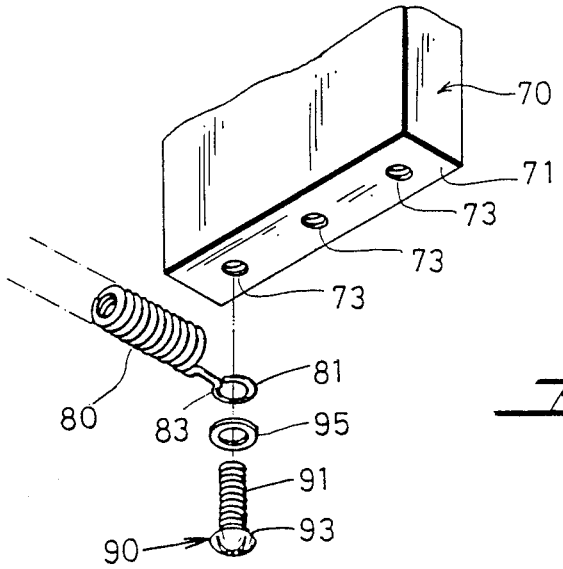
FIG. 4

HOLDING STRUCTURE FOR THE TREMOLO OF A GUITAR

BACKGROUND OF THE INVENTION

The present invention relates to a holding structure for the tremolo bridge of a guitar.

The tremolo bridge for a guitar holds the ends of the guitar strings and provides tension variations in the strings by shaking or vibrating of a bridge tail piece that is integrally connected to the tremolo bridge itself. A tremolo arm connected to the bridge is used to vibrate the bridge. The bridge tail piece has a base, with a front end which may serve as the focus or center for the shaking or vibration.

A hanging part at the lower surface of the bridge base is inserted into an opening in the guitar body and swings along the opening as the bridge vibrates. One end of a coil spring is secured to the lower surface of the hanging part. The opposite end of the coil spring is secured to the guitar body. The tension of that spring pulls in the opposite direction from the tension on the strings of the guitar. The bridge is thereby held by the spring under tension.

In prior guitars, the coil spring has been engaged by forming a hook at the end of the spring in the approximate shape of a right angle key which is inserted into an engagement opening at the lower end of the hanging part. That engagement opening for the hook of the coil spring is formed slightly larger than the diameter of that hook. This leaves room between the sides of the opening and the hook. As a result, when the bridge tail piece is shaken by means of the tremolo arm, an undesired sound, such as a squeaking sound, is produced.

According to the conventional structure, moreover, the positional relationship between the hook and the engagement opening tends to be broken by the shaking of the bridge tail piece, and this is a cause for variations in the tuning of the string.

If the tension of a string is increased in the so-called arm-up of the tremolo arm, in some cases the hook may gradually slide out of the engagement opening of the hanging part, since that movement arm-up is for the purpose of reducing the tension of the coil spring. Because of this, a suitable securement member has been provided in the past, thereby restricting the amount of the said arm-up in substance.

BRIEF DESCRIPTION OF THE PRESENT INVENTION

In the invention, the connection of the spring to the hanging part of the bridge tail piece is arranged so as to obviate major problems of the prior art, including connections which may loosen and provide improper control and undesired noise or variation in tone.

The present invention obviates the problems of the prior art which included generation of undesired sounds which had previously occurred on the shaking of the tremolo arm, the possibility of disengagement of the hook which connects the spring to the hanging part of the tremolo bridge, the loosening of the attachment of the tremolo spring to the tremolo part and the bending of the hook which effects such attachment thereby causing variations in the tuning of the strings. The invention also prevents upward movement of the tremolo arm from disengaging the spring from the hanging part.

The holding structure for a tremolo device of the present invention does not produce any unpleasant or unexpected sound, such as a squeaking sound, during use of the tremolo and makes it possible for the musician to operate the tremolo device without any risk that the coil spring for the tremolo device might accidentally slide out of engagement or change its angular position for the basic position of the tremolo arm or interfere with the so-called "arm-up" position.

In the present invention, the hanging part of the tremolo bridge which is below the lower surface of the bridge base of the bridge tail piece, is inserted into an opening in the guitar body. The bridge tail piece is held in such a manner as to be able to rotate or vibrate freely in a plane perpendicular to the plane of the top surface of the guitar around a pivot at the front of the tail piece. A coil spring is engaged on the lower part of the hanging part. An attachment piece, such as a hook, at the end of the coil spring is positively secured at the lower surface of the hanging part. Further, the neck part of the spring, just behind the attachment piece, is secured against the underside of the hanging part. This diminishes the possibility of squeaking or other undesired sounds to be produced or for sliding or slippage between the securement of the spring and the hanging part.

BRIEF DESCRIPTION OF THE DRAWINGS

The foregoing and objects and features of the present invention will be apparent in the following description and accompanying drawings in which:

FIG. 3 is an expanded perspective view showing the engagement structure of the coil spring of this invention; and FIG. 4 is an expanded perspective view showing an alternate coil spring engagement structure.

DETAILED DESCRIPTION OF THE INVENTION

Figure 1:
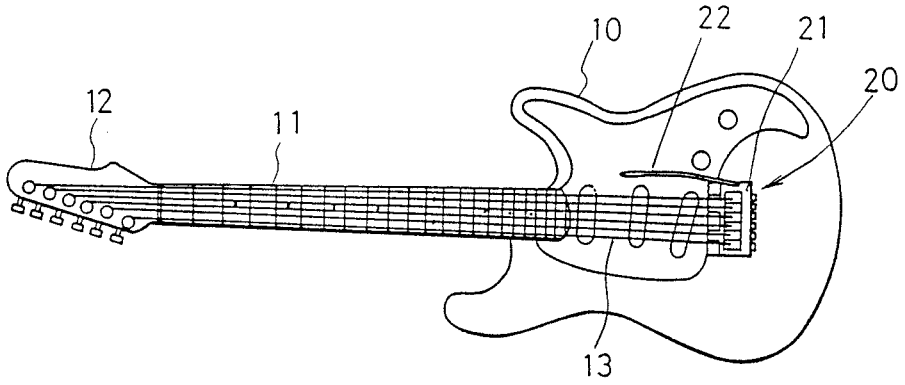
FIG. 1 shows a front view of an electric guitar which is equipped with a tremolo device according to the invention.

An electric guitar shown in FIG. 1 comprises a guitar body 10 provided with a neck 11, a head 12 for forward attachment and tuning of the strings, strings 13, a tremolo device 20 according to the present invention, a bridge tail piece 21 and a tremolo arm 22.

Figure 2:
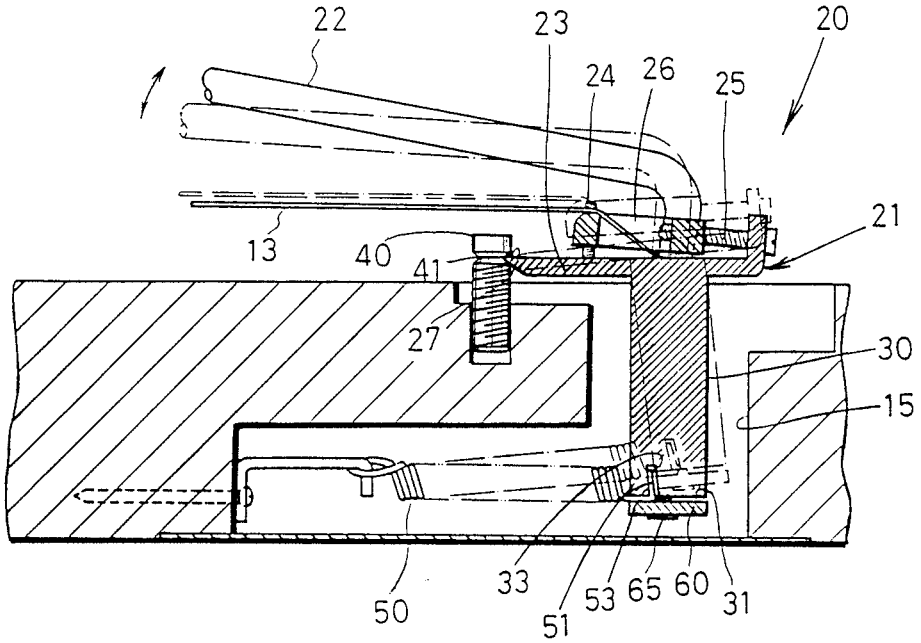
FIG. 2 is a partial cross section of an example of the holding structure of the tremolo device.

Referring to FIG. 2, the bridge tail piece 21 of the tremolo device 20 has an integral hanging or dependent part 30 at the lower surface of the bridge base 23.

Bridge tail piece 21 carries strings 13 in respective saddles 26 whose positions are adjusted and fixed by screws 24 and 25. The front edge of the bridge base 23 of the bridge tail piece 21 defines a pivot about which the tail piece 21 may rotate or vibrate freely with respect to the surface of the guitar body 10. That front edge is supported by a journal member 40 which has been fixed on the guitar body 10 and which has a groove part 41 that receives and journals the forward protrusion 27 of the bridge tail piece 21.

The hanging part 30 of the bridge base 23 is inserted into an opening 15 into the guitar body 10 which is wide enough to provide substantial clearance for the hanging part 30. At the lower surface of the hanging part 30, a coil spring 50 is engaged in such a manner as to pull the bridge tail piece 21 in a direction which is opposite to the direction of the tension on the strings 13.

The hook 51 at the end of the coil spring 50 is engaged in a respective opening 33 into the lower surface 31 of the hanging part 30. At the same time, the neck part 53 of the hook 51 is compressively tightened by screws 65 to be fixed beneath the hanging part 30. Screw openings 35 are provided in the lower surface 31 of the hanging part 30 for the screws 65.

A key-shaped hook 51 at the end of each coil spring 50 is inserted into the engagement opening 33. A compressive plate 60 that compressively secures the neck parts 53 of the springs, behind the hooks, is placed across the neck parts 53 of the springs for fixing the hooks to the hanging part 30. (See also FIG. 3.) Threaded screw receptacles 61 on the compressive plate 60 receive the sections 66 of the screws. The screws 65 are screwed into threaded openings 35 until the heads of the screws 65 press against the compressive plate 60. The hook 51 of the spring is held so that there is no possibility of unexpected disengagement of the hook 51 from the end of the hanging part 30.

FIG. 4 shows a somewhat modified form of the engagement structure of the coil spring. In this alternate engagement structure, the attachment piece 81 of the coil spring 80 is a substantially circular eye 81 rather than a hook. Threaded openings 73 are provided in the lower surface 71 of the hanging part 70 of the bridge tail piece. The circular eye 81 receives a screw shank 91 of a respective screw 90 which is screwed into a respective opening 73, with the neck 83 of the circular eye 81 being secured by the brim part 93 of the screw 90.

It will assist securing the coil spring 80 by providing a compressive washer 95 between the screw 90 and the eye 81. No plate, like plate 60, extending across all of the neck 83 is needed.

Because the attachment piece at the leading end of the coil spring is engaged at the lower surface of the hanging part while the neck part behind the attachment piece is compressively secured by a screw 65 to be fixed to the hanging part, the coil spring is firmly engaged with the hanging part. Even as the bridge tail piece shakes during use of the tremolo, there will be no generation of squeaking or other undesirable sounds, as in the past. In addition, there is no possibility of the coil spring sliding out of engagement with the hanging part, nor is there any possibility that the tuning of the string will be changed.

As there is no possibility for the coil spring to slide or fall away from the hanging part 30, it becomes possible to arrange a structure having a greater amount of tremolo movement and to increase the range of musical expression.

In the present invention, therefore, there is provided a novel tremolo device in which subtle variations of tone which happen to be undesired are obviated. In other words, the attachment particularly of the tremolo spring to the hanging part of the tail piece of the bridge is such that a positive engagement is achieved which removes the possibility of squeaking noises which occurred from the prior engagement which merely depended on a hook in an opening without any positive securement. Where the hook is used in the present case, the hook is positively secured by the screw 65 or the plate 60 it holds by the ring type of securement 81, 90, 95 of FIG. 4. The securement of the spring return or operating member for the tremolo device to the hanging device of the bridge tail piece is provided at the very end of the bridge tail piece to provide maximum effectiveness of the spring. The front end of the bridge as shown at elements 40–41 is hinged and held in position by the tension of the strings as well as by the spring so that the bridge and the bridge tail piece and the hanging member may all shake or vibrate freely in response to the operation of the tremolo arm 22. Since the coil spring cannot accidentally disengage from the hanging part of the bridge tail piece and since it cannot even shift in its securement with respect to it and cannot slide out of engagement, the noises inherent in prior methods of securement of the tremolo spring to any portion of the bridge are obviated and the musician may operate with complete peace of mind knowing that there is no basis for any extraneous or undesired noises.

In the foregoing, the present invention has been described in connection with preferred illustrative embodiments thereof. Since many variations and modifications of the present invention will now be obvious to those skilled in the art, it is preferred that the scope of this invention be determined, not by the specific disclosures herein contained, but only by the appended claims.

What is claimed is:

1. A tremolo device for a guitar wherein the guitar has a body, an opening defined in the body; a bridge disposed above the body surface, means for hingedly mounting the bridge for rotation in a plane perpendicular to the surface of the body of a guitar; the bridge having a tail piece for attachment thereto of guitar strings; a hanging part carried by the bridge tail piece, the hanging part having a lower end which is received in and movable in the opening in the body; a tremolo arm on the bridge operable to rotate the bridge on the hinge means;

a tension spring between the guitar body and the hanging part;

a connection between the tension spring and the lower end of the hanging part; the connection comprising a hook at the end of the spring; the spring having a neck behind the hook;

a receiver opening into the lower end of the hanging part and the hook extending into the receiver opening;

securement means for securing the neck of the attachment piece against the underside of the lower end of the hanging part; wherein the securement means comprises a compression plate for holding the neck to the hanging part and means for fixing the compression plate against the hanging part.

2. The tremolo device of claim 1, wherein the means for fixing comprises a screw for holding the compression plate in place.

* * * * *